US009425557B2

(12) United States Patent
Do

(10) Patent No.: US 9,425,557 B2
(45) Date of Patent: Aug. 23, 2016

(54) CONNECTOR UTILIZING CONDUCTIVE POLYMERS

(71) Applicant: APPLE INC., Cupertino, CA (US)

(72) Inventor: Trent K. Do, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 267 days.

(21) Appl. No.: 14/219,928

(22) Filed: Mar. 19, 2014

(65) Prior Publication Data

US 2014/0206237 A1 Jul. 24, 2014

Related U.S. Application Data

(63) Continuation of application No. 13/631,659, filed on Sep. 28, 2012, now Pat. No. 8,715,007.

(51) Int. Cl.

| | |
|---|---|
| ***H01R 13/659*** | (2011.01) |
| ***H01R 13/648*** | (2006.01) |
| ***H01R 13/6583*** | (2011.01) |
| ***H01R 13/6599*** | (2011.01) |
| ***H01R 13/658*** | (2011.01) |
| ***H01R 43/20*** | (2006.01) |
| ***H01R 43/26*** | (2006.01) |

(52) U.S. Cl.

CPC ..... *H01R 13/6485* (2013.01); *H01R 13/658* (2013.01); *H01R 13/6583* (2013.01); *H01R 13/6599* (2013.01); *H01R 43/205* (2013.01); *H01R 43/26* (2013.01); *H01R 2201/06* (2013.01); *Y10T 29/49147* (2015.01); *Y10T 29/49204* (2015.01)

(58) Field of Classification Search

CPC ..... H01R 13/6599

See application file for complete search history.

(56) References Cited

U.S. PATENT DOCUMENTS

| | | | | |
|---|---|---|---|---|
| 5,028,492 | A | 7/1991 | Guenin | |
| 5,509,823 | A | 4/1996 | Harting et al. | |
| 6,132,244 | A * | 10/2000 | Leeman | H01R 23/688 439/541.5 |
| 6,478,586 | B1 | 11/2002 | Ma | |
| 6,488,533 | B1 | 12/2002 | Thompson et al. | |
| 6,575,769 | B1 | 6/2003 | Takeuchi et al. | |
| 7,011,556 | B2 | 3/2006 | Miyazawa et al. | |
| 7,211,739 | B1 | 5/2007 | Brigham et al. | |
| 7,309,246 | B1 * | 12/2007 | Walter | H01R 13/6485 439/181 |
| 7,364,458 | B1 | 4/2008 | Ju | |
| D695,316 | S | 12/2013 | Akana et al. | |
| 8,715,007 | B2 | 5/2014 | Do | |
| 2002/0088628 | A1 * | 7/2002 | Chen | H05K 9/0018 174/359 |
| 2002/0098725 | A1 * | 7/2002 | Wallace | H01R 23/6873 439/86 |
| 2007/0128937 | A1 * | 6/2007 | Long | H01R 13/65802 439/607.01 |
| 2011/0111610 | A1 * | 5/2011 | Kim | H01R 13/6599 439/157 |
| 2012/0021631 | A1 * | 1/2012 | Yi | H01R 13/5202 439/271 |

(Continued)

OTHER PUBLICATIONS

Notice of Allowance for U.S. Appl. No. 13/631,659, mailed Dec. 23, 2013, 9 pages.

*Primary Examiner* — James Harvey

(74) *Attorney, Agent, or Firm* — Kilpatrick Townsend & Stockton LLP

(57) ABSTRACT

An improved electronic receptacle connector with portions thereof formed from an electrically conductive polymer is disclosed. A conductive polymer front face enables improved device aesthetics and can discharge electrostatic energy from a plug before it is mated with the connector. A conductive polymer housing with internal ground structures may provide electromagnetic interference shielding and improved data transfer speed.

19 Claims, 10 Drawing Sheets

(56) References Cited

U.S. PATENT DOCUMENTS

2013/0210261 A1 8/2013 Weber et al.
2013/0244472 A1 9/2013 Weber et al.
2013/0244496 A1 9/2013 Scritzky et al.
2013/0260615 A1 10/2013 Jol et al.
2014/0206237 A1* 7/2014 Do ..... H01R 13/6485
439/660

* cited by examiner

CONNECTOR UTILIZING CONDUCTIVE POLYMERS

CROSS-REFERENCES TO RELATED APPLICATIONS

This application is a continuation of U.S. application Ser. No. 13/631,659, filed Sep. 28, 2012, which is incorporated by reference herein in its entirety for all purposes.

BACKGROUND OF THE INVENTION

The present invention relates generally to electrical connectors and in particular to electrical connectors that are mounted to a printed circuit board (PCB) within an electronic device. A wide variety of electronic devices are available for consumers today. Many of these devices have connectors that that facilitate communication with and/or charging of a corresponding device. These connectors often interface with other connectors through cables that are used to connect devices to one another. Sometimes, connectors are used without a cable to directly connect the device to another device, such as a charging station or a sound system.

As an example, receptacle connectors are sometimes positioned on one or more of the surfaces of an electronic device and are mounted to a printed circuit board within the device. As smart-phones, media players, charging stations and other electronic devices become more compact, the electronic connectors may consume a considerable portion of the outer surfaces of the device, noticeably affecting the device's aesthetics. To achieve an aesthetically pleasing design it may be desirable to have the electronic connector approximately match the outer surfaces of the device.

Additional demands on electronic connectors employed in electronic devices may be to discharge electrostatic charges in the plug, support faster data transfer speeds and to shield electromagnetic noise from entering and leaving the device.

Thus, new connectors may require new features and/or changes to commonly used connectors to be able to meet aesthetic requirements, discharge electrostatic charges, increase data transfer speed and shield electromagnetic noise.

BRIEF SUMMARY OF THE INVENTION

Embodiments of the invention pertain to technology that is particularly useful in the manufacture of electronic connectors with portions thereof made from an electrically conductive polymer.

Some embodiments relate to the formation of electronic connectors that may have a front face that interfaces with a device housing. The front face may be comprised of an electrically conducive polymer that approximately matches the device housing to provide a uniform outer surface. Further, the front face may have interference features that force a mating connector to make physical contact with the front face before making contact with electrical contacts within the connector. The physical contact between the mating connector and the front face may discharge the electrostatic charges within the mating connector, the cable and the person.

Some embodiments of the invention may have a receptacle connector with an outer housing comprised of electrically conductive polymer. The outer housing may be connected to a ground and used for electromagnetic noise shielding. Further embodiments may have electrically conductive ground structures disposed on the interior of the outer housing. The ground structures may be disposed between contact structures that transfer electrical signals through the connector.

The ground structures and the contact structures may be designed to improve the impedance match within the connector and or to reduce signal cross-talk within the connector. Further embodiments may have an insert disposed within the housing to electrically isolate the ground structures from the contact structures.

Some embodiments may have a front interface plate, an outer housing and internal ground structures all comprised of a conductive polymer. In some embodiments these structures may be formed simultaneously in a single injection molding process.

To better understand the nature and advantages of the present invention, reference should be made to the following description and the accompanying figures. It is to be understood, however, that each of the figures is provided for the purpose of illustration only and is not intended as a definition of the limits of the scope of the present invention.

DETAILED DESCRIPTION OF THE INVENTION

Certain embodiments of the present invention relate to electrical connectors assembled to PCBs that may be employed in electronic devices. While the present invention can be useful to produce connector assemblies for a wide variety of electronic devices, some embodiments of the invention are particularly useful for producing connector assemblies for electronic devices that require particular electrostatic discharge features, aesthetic characteristics, faster data transfer speeds and/or electromagnetic noise shielding, as described in more detail below.

Figure 1:
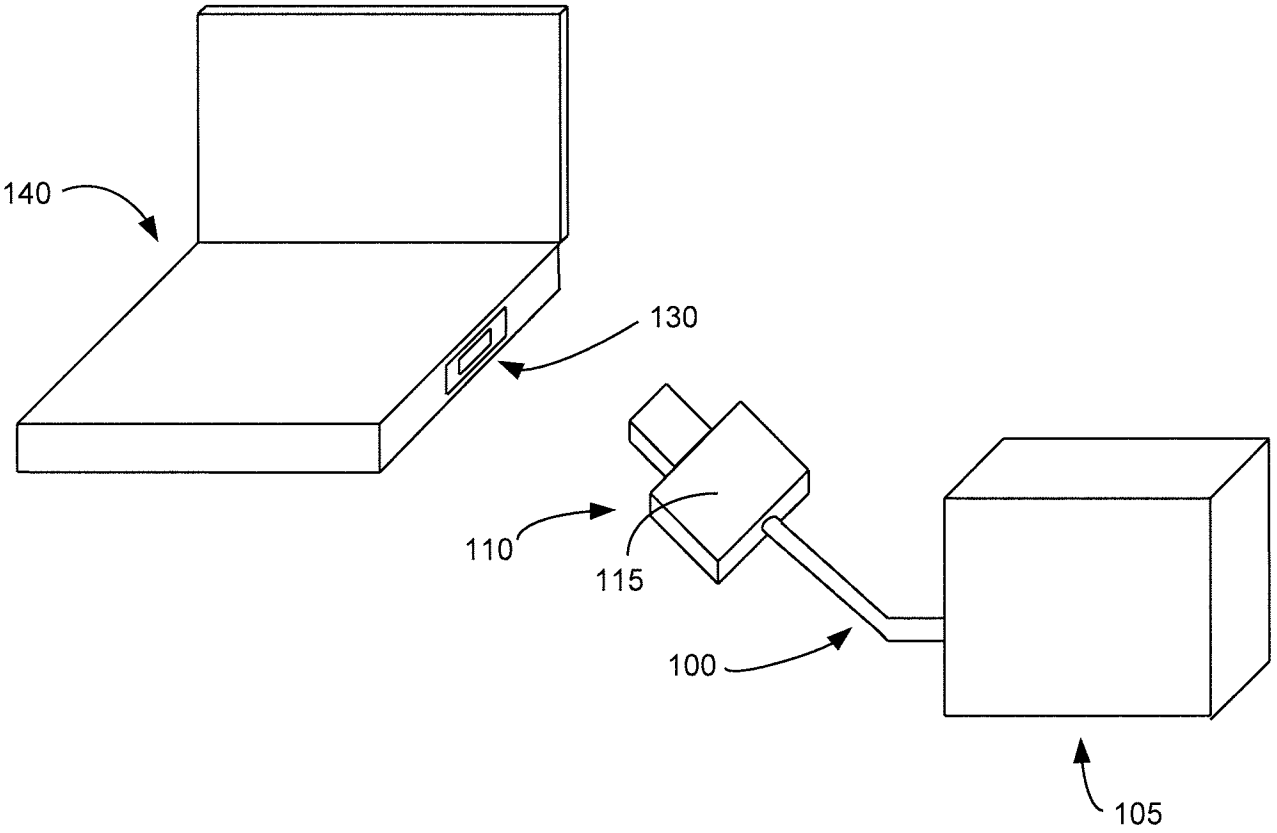
FIG. 1 is a diagram that illustrates an example of an electronic device and a peripheral device employing a receptacle connector and a connector plug, respectively.

Certain embodiments of the present invention relate to electrical connectors employed in electronic devices. Many electronic devices such as smart-phones, media players, and tablet computers have electronic connectors that facilitate battery charging and/or communication with other devices. The connectors include a plurality of electrical contacts through which electrical connections are made to another compatible connector to transfer power and/or data signals through the connectors. FIG. 1 illustrates an example of two such connectors including a plug connector 110 and a receptacle connector 130. Each of these connectors 110, 130 may comply with a well-known standard such as Universal Serial Bus (USB) 2.0, Firewire, Thunderbolt, or the like or may be proprietary connectors, such as the 30-pin connector used on many Apple products among other types of proprietary connectors.

As further shown in FIG. 1, plug connector 110 is coupled to a cable 100, which in turn is coupled to a peripheral device 105 that can be any of many different electronic devices or accessories that operate with such devices. Receptacle connector 130 is incorporated into a computing device 140. When the plug connector 110 is mated with the receptacle 130, electrical contacts within each electronic connector (not shown in FIG. 1) are in physical and electrical contact with each other to allow electrical signals to be transferred between computing device 140 and peripheral device 105.

To further illustrate embodiments of the invention, various examples of electrical connectors that include electrostatic discharge features, aesthetic characteristics, increased data transfer speed and electromagnetic noise shielding that may be made in accordance with the present invention are discussed below, however these embodiments should in no way limit the applicability of the invention to other connectors.

Figure 2:
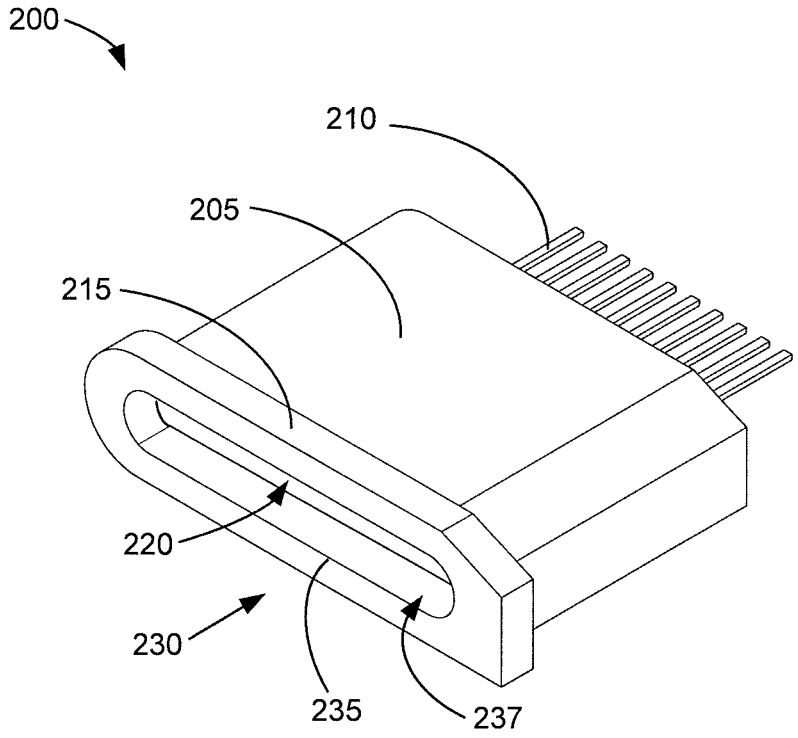
FIG. 2 is a diagram that illustrates a front perspective view of an electrical connector with a front interface plate in accordance with an embodiment of the invention.

FIG. 2 is a simplified perspective view of the front and top surfaces of an exemplary receptacle connector assembly 200, in accordance with one embodiment of the invention. Connector assembly 200 may include an outer housing 205 and may have a cavity 220 for receiving a plug portion of a mating connector (not shown). Outer housing 205 may be comprised of an electrically conductive polymer, a metal, or a combination thereof, as described in more detail below. Connector assembly 200 may have a front interface plate 215 that may also be comprised of an electrically conductive polymer, described in more detail below, and affixed to a receiving face 230 of the connector assembly. Front interface plate 215 may comprise an aperture 237 defined by perimeter 235, and may be aligned with cavity 220. A portion of aperture 237 may be slightly smaller in the width direction than the width a plug portion of a mating connector (not shown) forming an interference fit or otherwise forcing contact between the plug connector and interface plate, as described in more detail below. In some embodiments the dimensions of receptacle connector assembly 200 are less than 40 mm long by 40 mm wide by 8 mm thick. In other embodiments the dimensions of receptacle connector assembly 200 are less than 30 mm long by 30 mm wide by 7 mm thick. In further embodiments the dimensions of receptacle connector assembly 200 are less than 20 mm long by 20 mm wide by 6 mm thick. Also, in some embodiments, the width of aperture 237 is at least three times as long as the height of aperture 237.

Figure 3:
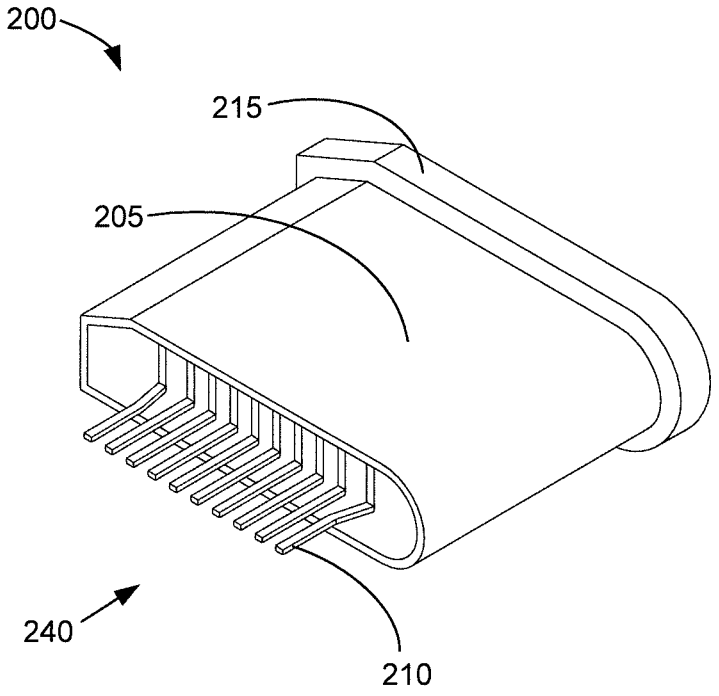
FIG. 3 is a diagram that illustrates a rear perspective view of an electrical connector with a front interface plate in accordance with an embodiment of the invention

A simplified perspective view of the rear and top surfaces of connector assembly 200 is shown in FIG. 3. Connector assembly 200 may have a rear face 240 disposed opposite receiving face 230, and outer housing 205 may extend there between. Rear face 240 may have a plurality of electrical leads 210 protruding from contact structures (not shown) disposed within outer housing 205 and shown in more detail in FIG. 9 below. The contact structures may be separated by ground structures (shown in FIG. 9) comprised of a conductive polymer, described in more detail below. Electrical leads 210 may be used to electrically connect connector assembly 200 to a printed circuit board or other electronic routing structure.

Figure 4:
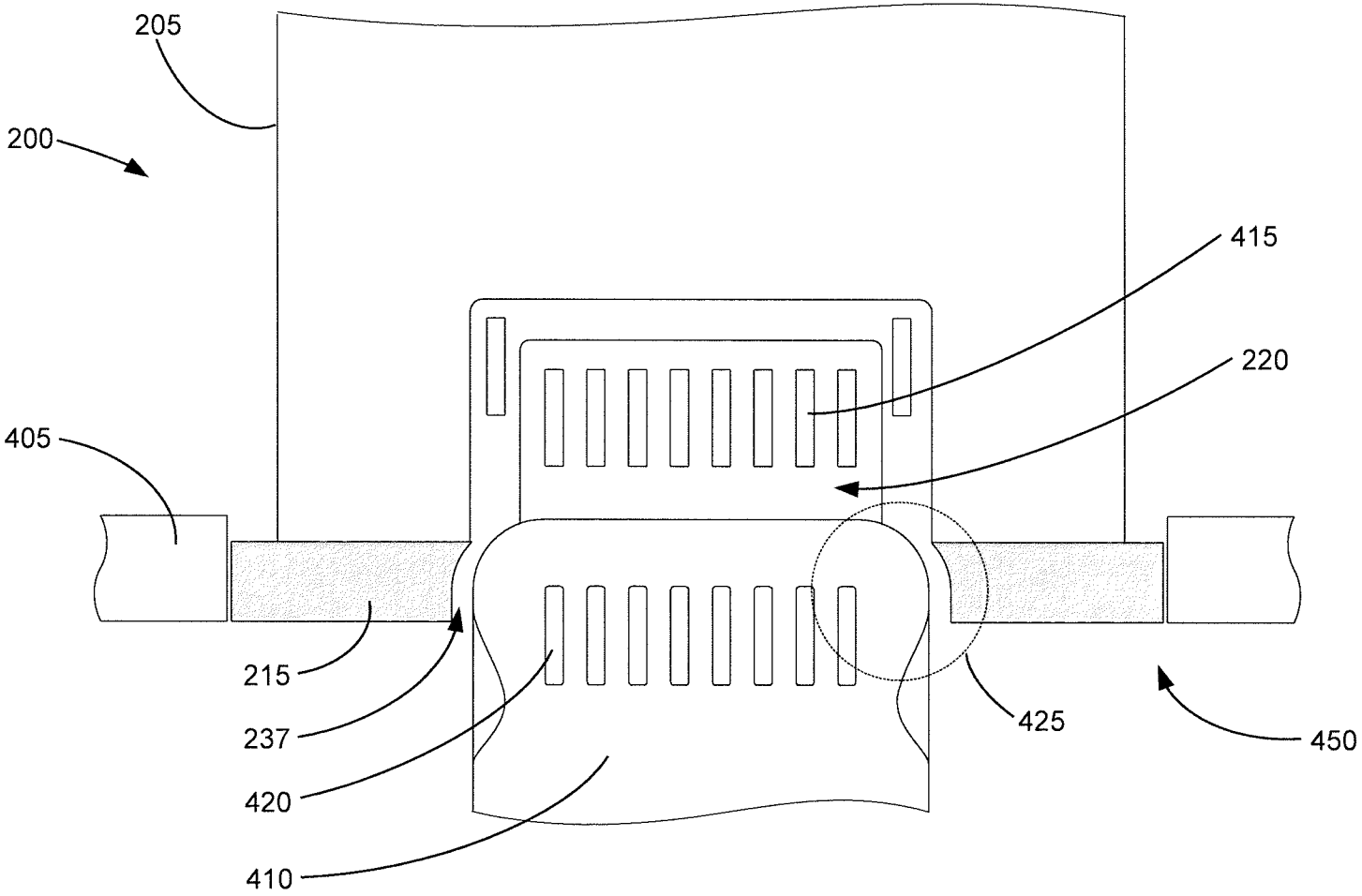
FIG. 4 is a diagram that illustrates a cross-sectional view of a plug entering a receptacle connector in accordance with an embodiment of the invention.

A simplified cross-section of a plug portion 410 of a mating connector entering cavity 220 through aperture 237 of front interface plate 215 is depicted in FIG. 4. Connector assembly 200 is depicted mounted in an exemplary electronic device (see FIG. 1) having device housing 405. As illustrated, front interface plate 215 of connector assembly 200 may be mounted substantially flush with the outer surface of device housing 405, which may result in a somewhat continuous exterior surface 450. In some embodiments, interface plate 215 may be comprised of an electrically conductive polymer. In some embodiments, the electrically conductive polymer of interface plate 215 may be colored to approximately match the color of device housing 405, providing a somewhat uniform outer surface 450. In other embodiments, the conductive polymer comprising interface plate 215 may be colored differently from device housing 405 to provide a different aesthetic appearance. In other embodiments, interface plate 215 may be comprised of a non-electrically conductive polymer. The geometry of front interface plate 215 and the way it engages with device housing, as depicted in FIG. 4, is for exemplary purposes only, and other geometries and methods of engagement are within the scope of the invention.

In some embodiments where interface plate 215 may be comprised of an electrically conductive polymer, the interface plate may be connected to a local ground. In some embodiments, interface plate 215 may be used to discharge electrostatic charges built up in plug portion 410 of mating connector, its cable (not shown) and the person holding the plug. In some embodiments, it may be desirable to discharge the electrostatic charges before plug contacts 420 make electrical contact with receptacle contact tips 415. In some embodiments, electrostatic discharge can damage electronic components within the electronic device, if not discharged to ground before electrical contacts 420 engages contact tip 415 are engaged. To ensure discharge of the electrostatic charges, it may be desirable to force plug portion 410 to make physical contact with the electrically conductive polymer comprising interface plate 215. To this end, in some embodiments of the invention, interface plate 215 includes an inference feature as described in more detail below.

Figure 5:
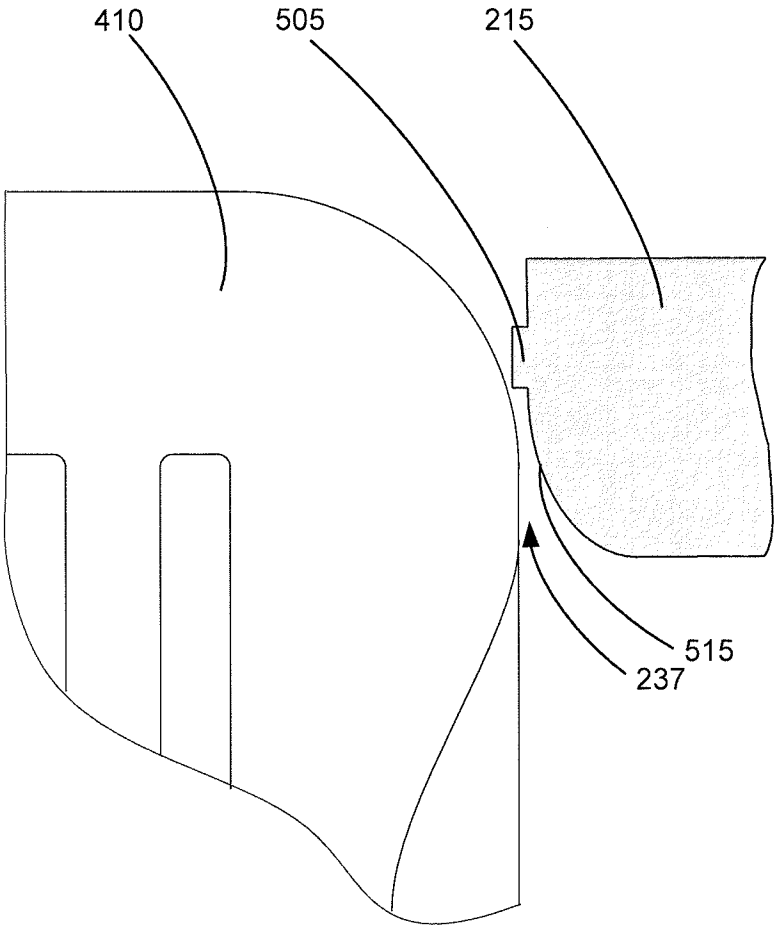
FIG. 5 is a diagram that illustrates a close-up of a portion of a plug and a front interface plate in accordance with an embodiment of the invention.
Figure 6:
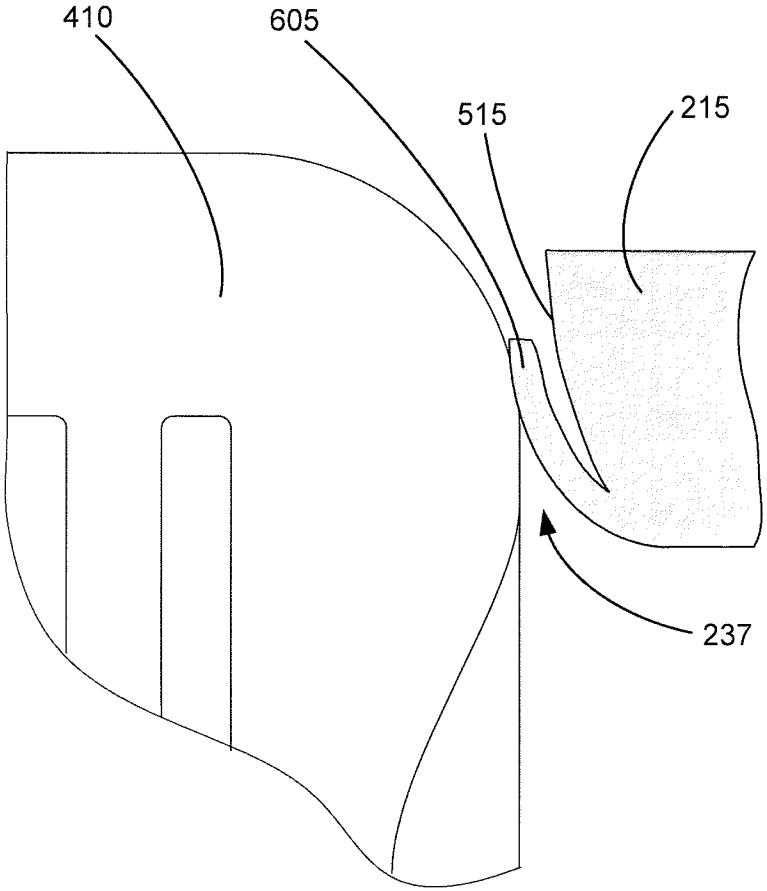
FIG. 6 is a diagram that illustrates a close-up of a portion of a plug and a front interface plate in accordance with an embodiment of the invention.

Simplified close ups 425 of plug portion 410 of a receptacle connector and front interface plate 215 according to two different embodiments of the invention are shown in FIGS. 5 and 6. In one embodiment, depicted in FIG. 5, a protuberance 505 may protrude from inner surface 515 of front interface plate 215 aperture 237. In some embodiments protuberance 505 may decrease the size of aperture 237 of front interface plate 215 to be smaller than the width of plug portion 410 of the receptacle connector, resulting in an interference fit. Thus, in these embodiments, plug portion 410 of the receptacle connector may physically contact and deflect protuberance 505 to gain entry to cavity 220 (see FIG. 4). The physical contact between plug portion 410 and protuberance 505 may result in an electrical connection between the plug portion and the front interface plate (comprised of an electrically conductive polymer), thus creating a path for the discharge of static electricity from the plug portion through the electrically conductive front interface plate to a ground. In some embodiments plug portion 410 may be comprised of a harder material than protuberance 505 such that the plug portion is not marred when it physically contacts the protuberance. In some embodiments, plug portion 410 may be comprised of metal and protuberance 505 may be comprised of a conductive plastic with a modulus of elasticity and yield strength sufficient to withstand repeated protuberance deformation cycles without permanently deforming. In some embodiments, wherein the conductive plastic is comprised of a relatively higher modulus material, the size of protuberance 505 may be reduced to allow ease of entry of plug portion 410. Conversely, in embodiments that may use a relatively lower modulus conductive plastic, protuberance 505 may be enlarged while still allowing ease of entry of plug portion 410.

In some embodiments, the conductive polymer used to manufacture front interface plate 215 may be made from a thermoplastic resin containing metallic fibers. In some embodiments the thermoplastic resin may be nylon, Polybutylene Terephthalate (PBT), Acrylonitrile Butadiene Styrene (ABS) or Liquid-Crystal Polymer (LCP). Other thermoplastics may be used without departing from the invention. In some embodiments the polymer may be filled with carbon fibers, carbon nanotubes, metallic powder, carbon powder, graphite or other conductive materials to make the polymer electrically conductive. In other embodiments a thermosetting polymer may be used in place of the thermoplastic polymer.

An alternative embodiment of front interface plate 215 is depicted in FIG. 6. In this embodiment a deflectable arm 605 may protrude from inner surface 515 of front interface plate 215 aperture 237. In some embodiments deflectable arm 605 may decrease the size of aperture 237 of front interface plate 215 to be smaller than the width of plug portion 410 of the receptacle connector (as discussed above). Thus, in these embodiments plug portion 410 of the receptacle connector may physically contact and deflect deflectable arm 605 to gain entry to cavity 220 (see FIG. 4). The physical contact between plug portion 410 and deflectable arm 605 may result in an electrical connection between the plug portion and the front interface plate (comprised of an electrically conductive polymer, as discussed above), thus creating a path for the discharge of static electricity from the plug portion through the electrically conductive front interface plate to a ground. More than one protuberance 505, 605 may protrude from inner surface 515. Some embodiments may have interference features on two, three or all four sides of inner surface 515. Further embodiments may have two opposing interference features disposed on opposite sides of inner surface 515.

In some embodiments, front interface plate 215 may be screwed, bolted, riveted or fastened by other mechanical means to connector assembly 200 (see FIG. 2). In other embodiments, front interface plate 215 may be affixed to connector assembly 200 by an insert-molding process and in still other embodiment interface plate 215 and housing 205 may be integrally formed together as a single piece with an injection molding process. In some embodiments, protuberance 505 (see FIG. 5) and deflectable arm 605 may be formed by an injection molding process together with interface plate 215. For example, in one embodiment front interface plate 215 may be insert-molded on connector assembly 200 (see FIG. 2), simultaneously forming deflectable arm 605. Other features and designs of interference features like protuberance 505 (see FIG. 5) and deflectable arm 605 may be employed without departing from the invention. For example, the interference feature may be a hemispherical bump, a series of protrusions in vertical orientation, a series of protrusions in horizontal orientation, or any other feature that may protrude from surface 515 such that plug portion 410 may make physical contact with it to gain entry to cavity 220 (see FIG. 2). Some embodiments may require deflectable arm 605 to be inverted such that the insert-mold tool can form the arm from the front of the connector.

In some embodiments, front interface plate 215 may be connected to a ground through outer housing 205 (see FIG. 2) of connector assembly 200. In other embodiments, an independent ground path may be used to connect front interface plate 215 to a ground.

Figure 7:
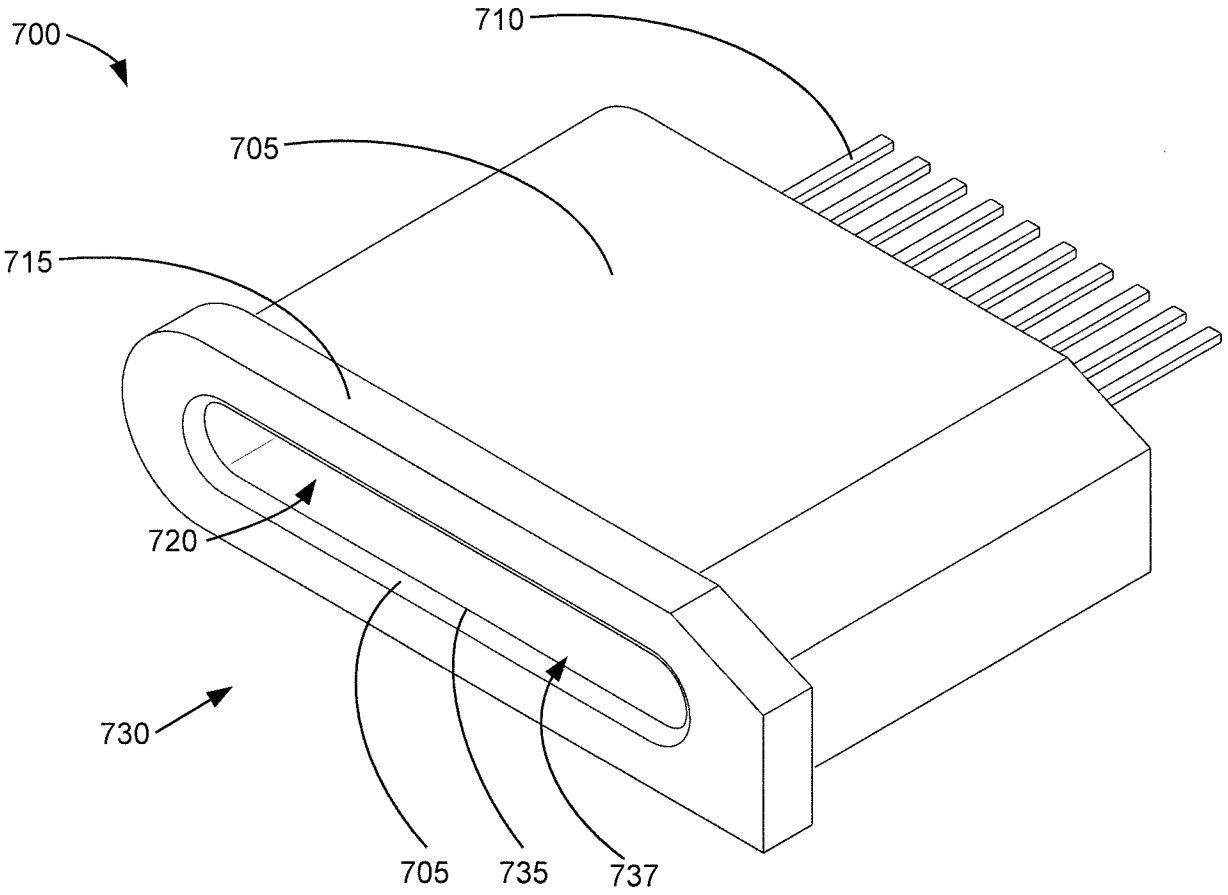
FIG. 7 is a diagram that illustrates a front perspective view of an electrical connector with a front interface plate in accordance with an embodiment of the invention.

Some embodiments, as depicted in FIG. 7, may have a front interface plate 715 with features that aid the entry of plug portion 410 (see FIG. 4) into connector assembly 700. A simplified perspective view of the front and top surfaces of another exemplary receptacle connector assembly 700, in accordance with one embodiment of the invention, is shown in FIG. 7. Connector assembly 700 may include an outer housing 705 and may have a cavity 720 for receiving a plug portion of a mating connector (not shown). Outer housing 705 may be comprised of an electrically conductive polymer, a metal, or a combination thereof, as described in more detail below. Connector assembly 700 may have a front interface plate 715 that may also be comprised of an electrically conductive polymer, and affixed to a receiving face 730 of the connector assembly. Front interface plate 715 may comprise an aperture 737 defined by perimeter 735, and may be aligned with cavity 720. The size of a portion of aperture 737 may be smaller than a size of a plug portion 410 (see FIGS. 4-6) of a mating connector, as previously described with regard to the formation of interference features. Further, front interface plate 715 may comprise entry features 705, such as a bevel or a radius to accommodate connectors more easily, and to avoid sharp edges that might otherwise be presented to the user, among other purposes.

Figure 8:
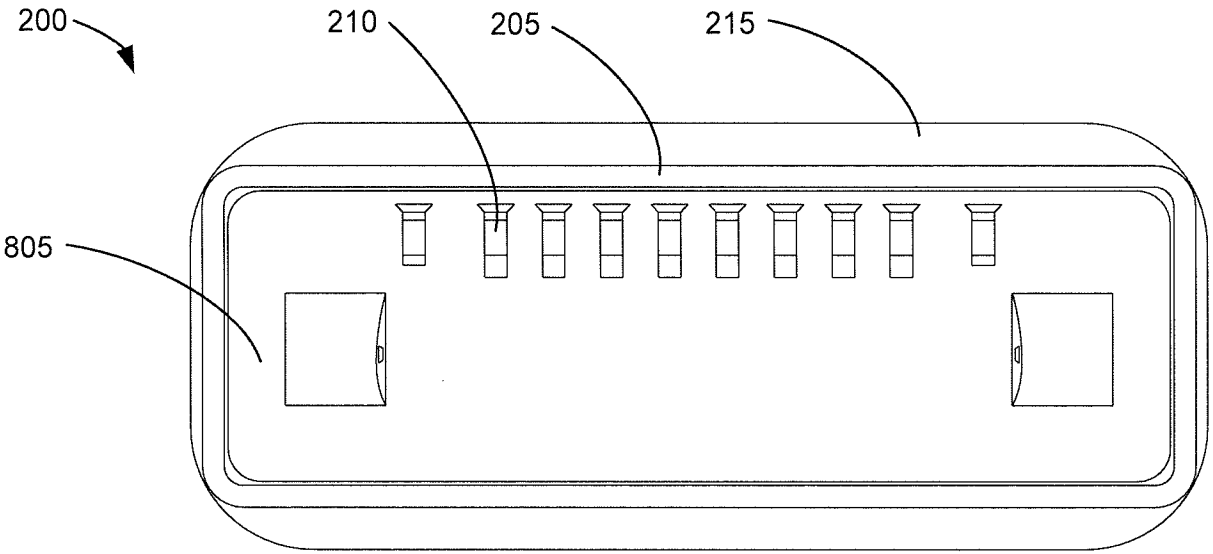
FIG. 8 is a diagram that illustrates a rear view of an electrical connector with a front interface plate in accordance with an embodiment of the invention.

As mentioned supra, in some embodiments outer housing 205 (see FIG. 2) may be comprised of an electrically conductive polymer. In some embodiments this may provide a ground path to front interface plate 215 (see FIG. 2) for the discharge of static electricity from plug portion 410 (see FIG. 4). In other embodiments, constructing outer housing 205 (see FIG. 2) from a conductive polymer may provide electromagnetic shielding for the electronic device and connector assembly 200. More specifically, in some embodiments the electronic device may require connector assembly 200 (see FIG. 2) to shield electromagnetic noise from entering the electronic device and or from leaving the electronic device. By manufacturing outer housing 205 (see FIG. 2) from an electrically conductive polymer and connecting outer housing to a ground, electromagnetic shielding may be achieved. Further, an electrically conductive rear enclosure 805 as depicted in FIG. 8 may be electrically connected to rear face 240 (see FIG. 2) of outer housing 205 to further shield electromagnetic noise from entering or leaving the electronic device. In some embodiments conductive outer housing 205 (see FIG. 2) and conductive rear enclosure 805 may operate in conjunction with a conductive device housing 405 (see FIG. 4) to substantially form a faraday cage around the electronic device for electromagnetic shielding purposes.

In some embodiments both outer housing 205 (see FIG. 2) and front interface plate 215 may be made from an electrically conductive polymer. In some embodiments, both outer housing 205 (see FIG. 2) and front interface plate 215 may be formed as a substantially unitary structure. In some embodiments, both outer housing 205 (see FIG. 2) and front interface plate 215 may be insert-molded over connector assembly 200. In further embodiments, rear enclosure 805 (see FIG. 8) may be unitary with outer housing 205 (see FIG. 2) and front interface plate 215 while in other embodiments it may be a separate structure. Other combinations of unitary and non-unitary construction combinations of front interface plate 215 (see FIG. 2), outer housing 205 and rear enclosure 805 (see FIG. 8) are within the scope of the invention.

Figure 9:
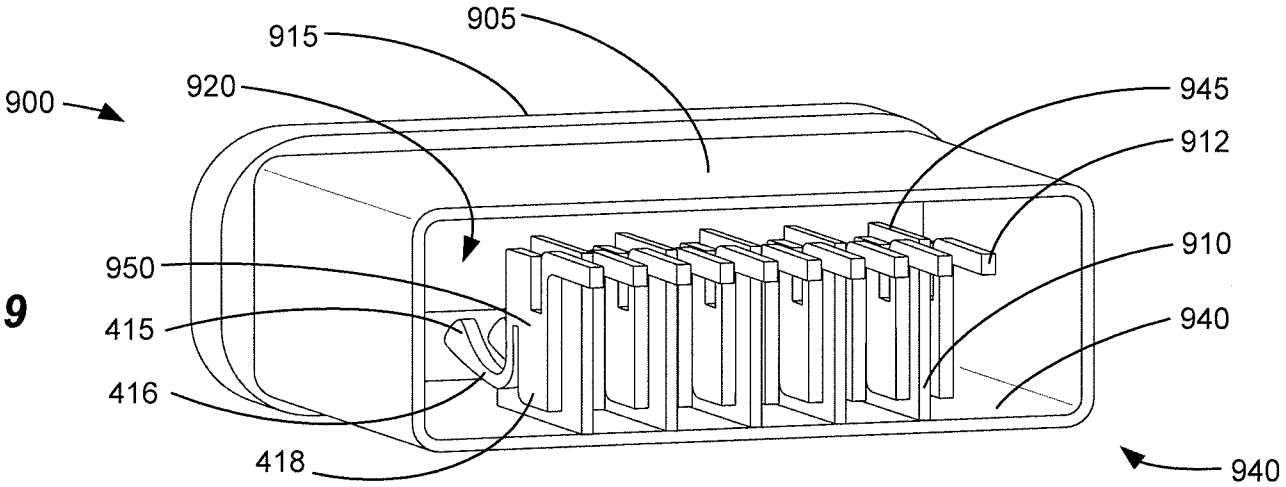
FIG. 9 is a diagram that illustrates a rear perspective view of an electrical connector with ground structures in accordance with an embodiment of the invention

Now referring to FIG. 9, some embodiments may comprise ground structures 910 formed inside of connector assembly 900 to separate adjacent contact structures 950, each of which includes an elongated beam portion 416 positioned between a contact tip 415 and an anchor portion 418. Each contact tip 415 is positioned within cavity 920 (see also FIG. 4) so that it can be electrically coupled to a corresponding plug connector contact during a mating event. Beam portion 416 allows the tip of each contact to flex slightly downward during a mating event and biases the tip to keep physical and electrical contact with a contact in the plug connector that aligns with the particular receptacle contact. Anchor portion 418 may be a substantially flat plate with one or more cutouts that fits within a slot (not shown) of the receptacle connector housing to secure or anchor the contacts in place. Contact structures 950 may further include electrical leads 912 that extend out of rear face 940 of connector assembly 900 that can couple the receptacle connector to a printed circuit board or similar substrate in an electronic device the receptacle connector is part of In some embodiments, ground structures 910 can be substantially flat plates that are positioned adjacent to and/or sized to substantially cover (when viewed from the side) the anchor portion of one or more contact structures.

In some embodiments ground structures 910 may be made from an electrically conductive polymer when they are required to be electrically conductive, however in other embodiments a non-electrically conductive polymer may be used when they are not required to be electrically conductive. In some embodiments, outer housing 905 may have an inner surface 940 having one or more ground structures 910 extending from a base disposed on the inner surface to distal end 945. In further embodiments, ground structures 910 may be substantially unitary with outer housing 905. In other embodiments, outer housing 905 and ground structures 910 may be injection molded at the same time. In some embodiments, ground structures 910 may be comprised of metal and be insert-molded during the injection molding of outer housing 905. In various embodiments, ground structures 910 may be placed between each and every contact structure 950 included in connector assembly 900 or may be placed between only certain contact structures 950. For example, as depicted in FIG. 9, there are ten contact structures 950 and five ground structures 910. In one particular embodiment, the outer two contact structures 950 are connector detect contacts (as opposed to signal contacts) that can be used to detect when a plug connector is inserted into the receptacle connector cavity, the inner eight contact structures as data, power and ground contacts (referred to collectively as "signal contacts") and connector assembly 900 includes five ground structures 910. In one version of this embodiment shown in FIG. 9, the contacts and ground structures are positioned in the following order: connector detect contact structure, ground structure, two signal contact structures, ground structure, two signal contact structures, ground structure, two signal contact structures, ground structure, two signal contact structures, ground structure, connector detect contact structure.

In some embodiments, ground structures 910 may be used to shield noisy signals from sensitive signals within the connector. For example, in some embodiments contact structures 950 that are used to transmit power may be shielded by ground structures 910 from contact structures 950 that are used to transmit data. In other embodiments, for example, contact structures 950 may be used to transmit high-speed data using a matched impedance differential pair of conductors. In these embodiments, contact structures 950 and ground structures 910 may be designed to minimize the discontinuity in impedance within connector assembly 900 to maximize the bandwidth of the differential pair. Similar uses may be employed for single ended high-speed conductors, such as, for example coaxial, microstrip, stripline and general transmission line designs, where ground structures 910 may be employed to minimize impedance disruption within connector assembly 900. In other embodiments, contact structures 950 and ground structures 910 may be designed to reduce cross-talk between adjacent data signals. Other uses, benefits and features of disposing ground structures 910 between or adjacent to contact structures 950 may be used without departing from the invention. Electromagnetic simulation using, for example, a full-field electromagnetic solver, may be employed and may result in optimized contact structures 950 and ground structures 910 that look significantly different than depicted here. Such features and benefits thereof are fully contemplated herein and may be employed without departing from the invention.

Figure 10:
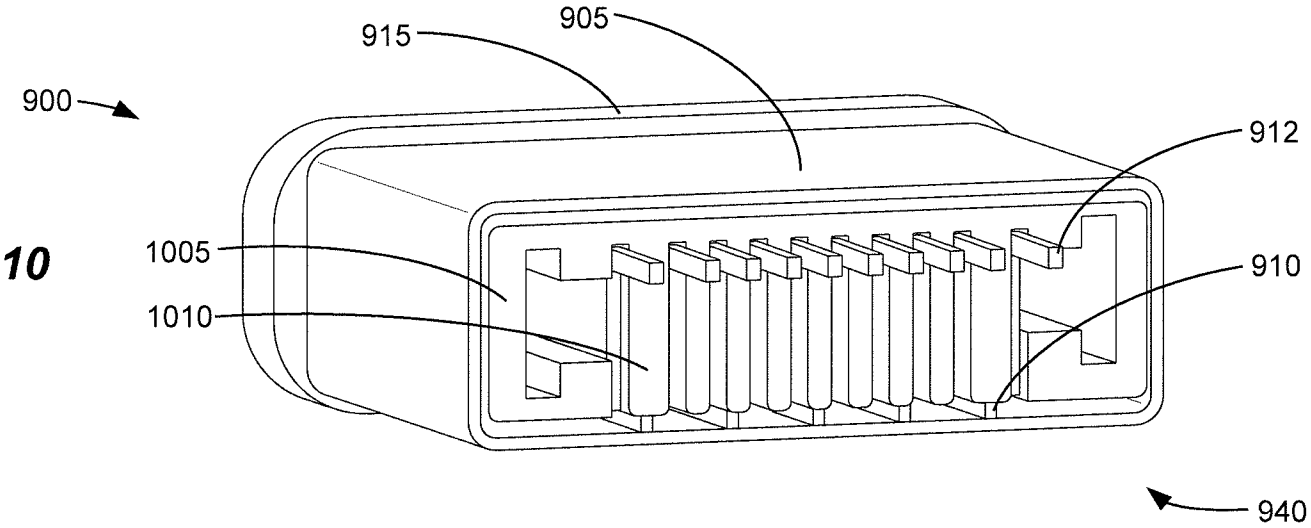
FIG. 10 is a diagram that illustrates a rear perspective view of an electrical connector with ground structures and an insert in accordance with an embodiment of the invention

Some embodiments may employ an insert 1005, as depicted in FIG. 10. Insert 1005 may have one or more fingers 1010 that may be disposed over ground structures 910 (see FIG. 9). More specifically, portions of fingers 1010 may be disposed between ground structures 910 (see FIG. 9) and contact structures 950 such that the ground structures may be electrically isolated from the contact structures. In other embodiments, fingers 1010 may be disposed over ground structures 910 (see FIG. 9) and contact structures 950. In other embodiments, portions fingers 1010 may not be disposed between ground structures 910 (see FIG. 9) and contact structures 950. In some embodiments, insert 1005 may be injection molded from a non-electrically conductive polymer, while in other embodiments it may be comprised of a conductive polymer or a different material. Further, in some embodiments, insert 1005 and rear enclosure 805 (see FIG. 8) may both be employed.

It will be appreciated that connector assemblies 200, 700 and 900 described herein are illustrative and that variations and modifications are possible. For instance, some embodiments may comprise an electrically conductive front interface plate 915 (see FIG. 9), while others may comprise an electrically conductive outer housing 905 while others may comprise an electrically conductive housing and ground structures 910. Further embodiments may comprise an electrically conductive front interface plate 915, as well as an electrically conductive outer housing 905 and ground structures 910. Other various combinations of these features and other disclosed features may be employed without departing from the invention. As briefly mentioned above, myriad formulations of conductive polymers are available and particular formulations may be more beneficial for one embodiment than another. For example, some embodiments that only employ conductive polymers for electrostatic discharge may be able to use a polymer with lower electrical conductivity which may have a lower cost than some embodiments that may use conductive polymers for electromagnetic shielding. Myriad variations of conductive polymers may be used for myriad features within connector assemblies 200, 700 and 900 without departing from the invention. For instance, in one embodiment a single conductive polymer may be used to form one or more electrically conductive features. In another embodiment, a two-shot molding process may be employed where one conductive polymer may be used for one feature while a different conductive polymer may be used for another feature.

In another embodiment a non-electrically conductive polymer may be used with an electrically conductive polymer.

Figure 11:
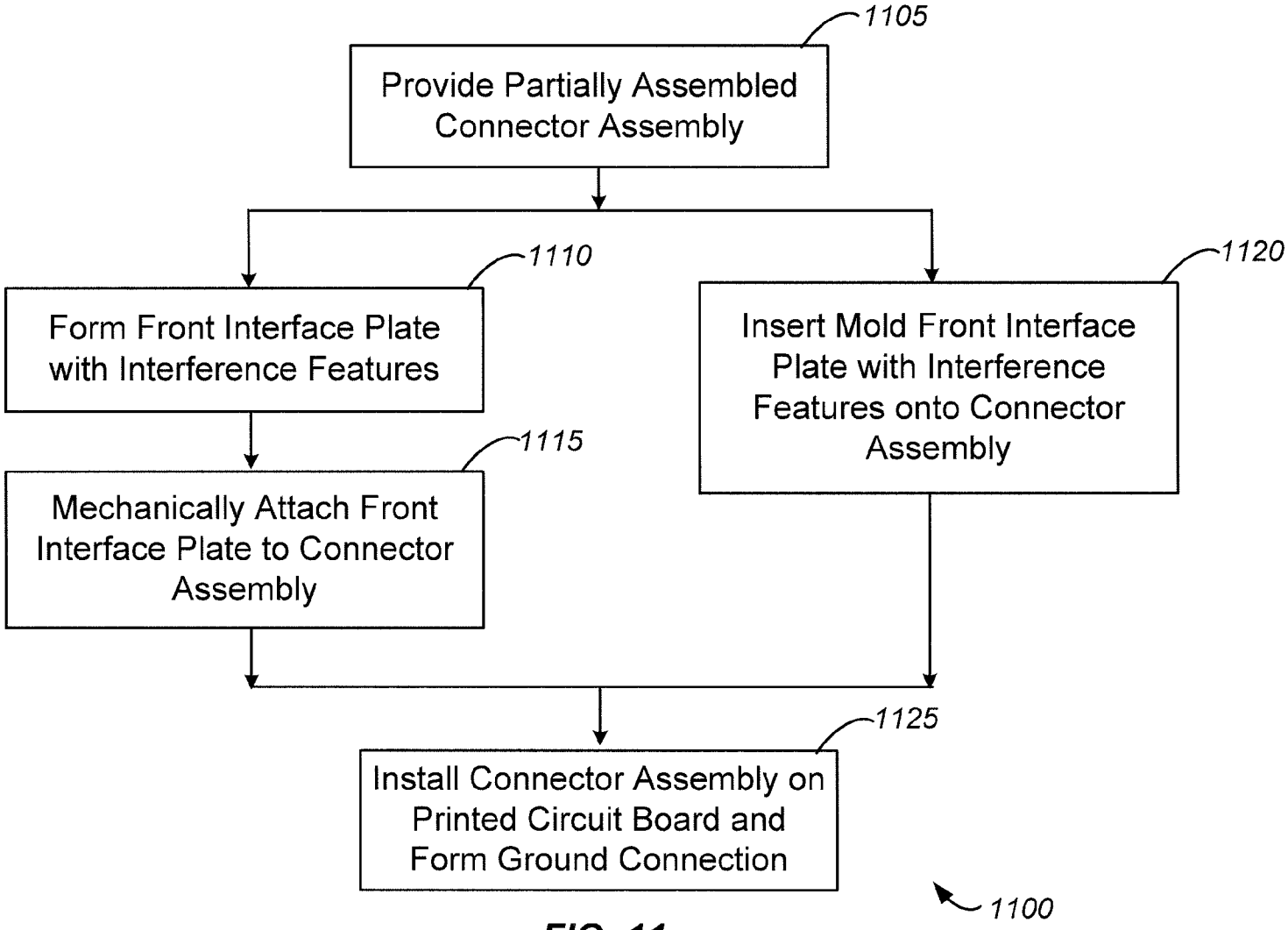
FIG. 11 is a process by which a connector with a front interface plate comprised of conductive polymer can be made in accordance with an embodiment of the invention.

An exemplary simplified process for manufacturing a connector assembly comprising an electrically conductive front interface plate, in accordance with embodiments described herein, is depicted in FIG. 11. In step 1105 a partially assembled connector assembly may be provided. Two different methods may be employed to attach the front interface plate to the connector assembly. The first method may employ step 1110 where the front interface plate may be formed as a separate structure using, for instance, injection molding and an electrically conductive polymer. During the formation of the front interface plate, interference features may be formed in the aperture of the plate. In step 1115 the front interface plate may be mechanically attached to the connector assembly. This may be performed using, for example, fasteners, interference fit features or hot-melt features on the front interface plate. The connector assembly is completed and in step 1125 the connector assembly may be installed on a printed circuit board. Using an alternative method, in step 1120, the connector assembly may be placed in an insert-molding machine and the front interface plate may be insert-molded on the connector assembly using an electrically conductive polymer. During the formation of the front interface plate, interference features may be formed in the aperture of the plate. The connector assembly is completed and in step 1125 the connector assembly may be installed on a printed circuit board. The front interface plate connection to ground may be formed by installing the connector assembly on the circuit board. For instance, the front interface plate may be electrically connected to a metallic outer housing that may be electrically connected to ground. Other embodiments may form a separate electronic connection between the front interface plate and ground.

Figure 12:
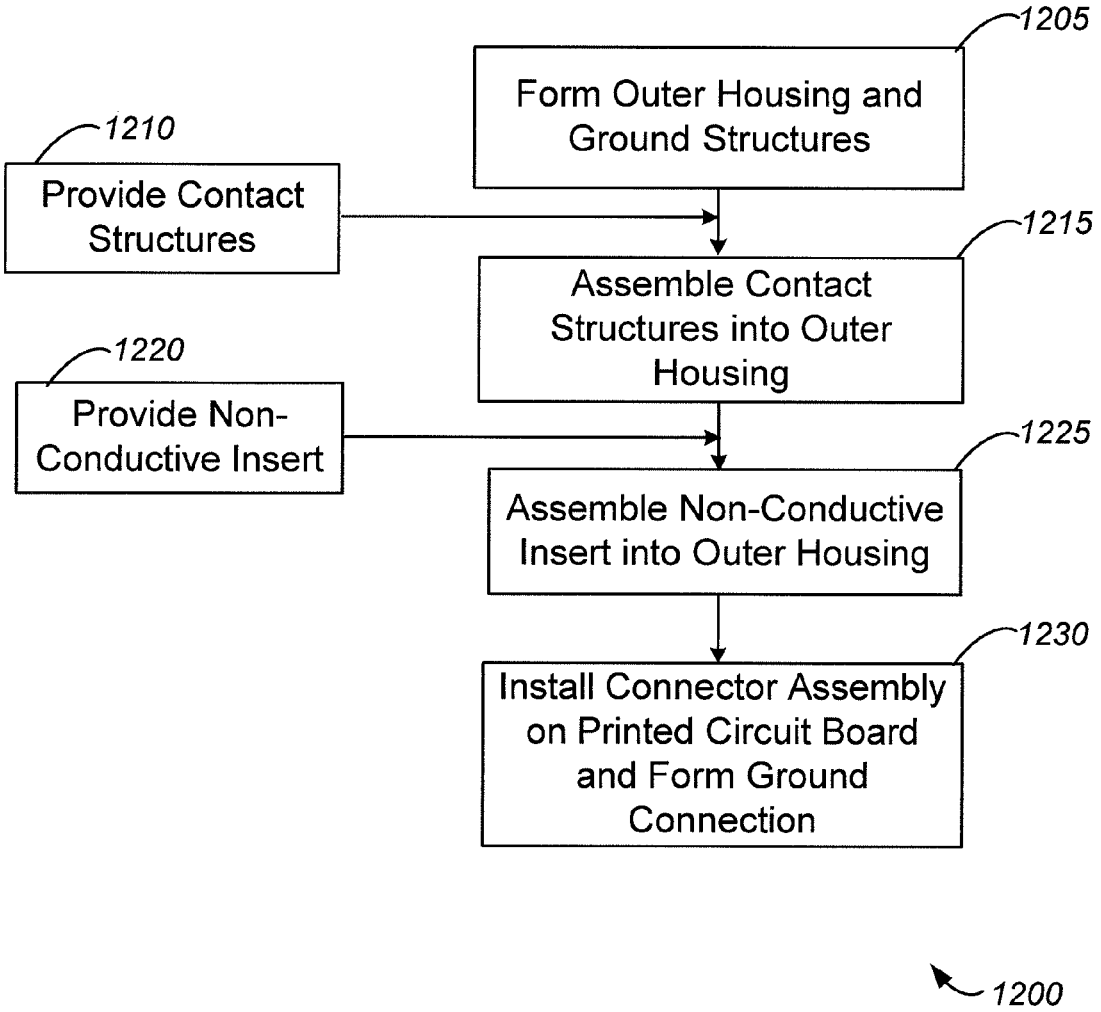
FIG. 12 is a process by which a connector with ground structures comprised of conductive polymer can be made in accordance with an embodiment of the invention.

An exemplary simplified process for manufacturing a connector assembly comprising electrically conductive ground structures disposed between contact structures, in accordance with embodiments described herein, is depicted in FIG. 12. In step 1205 an outer housing with ground structures may be formed from an electrically conductive polymer. The housing and ground structures may be formed, for example, using injection molding, insert molding or machining In step 1210 contact structures are provided. The contact structures may be, for example, formed from stamped and plated metal. In step 1215 the contact structures may be assembled into the outer housing. The contact structures may have a carrier that holds them together, or they may be assembled as individual components. In step 1220 a non-conductive insert may be provided. The non-conductive insert may be formed, for example, using injection molding, insert-molding or machining In step 1225, the non-conductive insert may be installed in the outer housing. An optional rear enclosure may be assembled on the rear face of the connector assembly. In step 1230 the connector assembly is complete and may be installed on a printed circuit board. The outer housing connection to ground may be formed by installing the connector assembly on the circuit board. For instance, the outer housing may be electrically connected to a ground connection on the printed circuit board. Other embodiments may form a separate electronic connection between the outer housing and ground.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An electrical receptacle connector comprising:

a housing having a front opening that opens to a cavity for receiving a plug portion of a mating connector;

an interface plate comprising an electrically conductive polymer, the interface plate having an inner surface defining an aperture and being coupled to the housing such that the aperture is aligned with the cavity; and one or more interference features protruding from the inner surface into the aperture.

2. A method of manufacturing an electrical receptacle connector, the method comprising:

forming a housing defining a cavity for receiving a plug portion of a mating connector; and attaching an interface plate comprising an electrically conductive polymer to the housing such that an aperture of the interface plate is aligned with the cavity, wherein the aperture includes an inner surface and at least one interference feature protruding from the inner surface.

3. The electrical receptacle connector set forth in claim 1 wherein the one or more interference features are disposed on two opposing sides of the inner surface.

4. The electrical receptacle connector set forth in claim 1 wherein the one or more interference features are disposed on first and second pairs of opposing sides of the inner surface.

5. The electrical receptacle connector set forth in claim 1 wherein the one or more interference features are deflectable by the plug portion of the mating connector.

6. The electrical receptacle connector set forth in claim 1 wherein the aperture is surrounded by a chamfered entry feature formed on the interface plate.

7. The electrical receptacle connector set forth in claim 1 further comprising a plurality of electrical leads disposed within the housing.

8. An electrical receptacle connector comprising:

a front face having an interface plate comprising an electrically conductive polymer;

a rear face disposed opposite the front face;

a housing comprising an electrically conductive polymer extending between the front face and the rear face, the housing defining a cavity that communicates with an aperture in the interface plate;

a plurality of electrical contacts disposed within the cavity configured to interface with a plug portion of a mating plug connector; and a ground structure disposed within the cavity and extending along the housing from a first end proximate the front face to a second end proximate the rear face, the ground structure further extending from a base connected to the housing to a distal edge within an interior of the cavity, wherein at least a portion of the ground structure is located between two or more of the plurality of electrical contacts.

9. The electrical receptacle connector set forth in claim 8 wherein the ground structure comprises an electrically conductive polymer.

10. The electrical receptacle connector set forth in claim 8 wherein the ground structure comprises metal.

11. The electrical receptacle connector set forth in claim 8 wherein the ground structure is connected to ground.

12. The electrical receptacle connector set forth in claim 8 wherein the interface plate includes an inner surface that defines the aperture and one or more interference features protruding from the inner surface into the aperture.

13. The electrical receptacle connector set forth in claim 12 wherein the one or more interference features are deflectable by the plug portion of the mating connector.

14. An electronic device comprising:

a device housing; and a connector assembly comprising a connector housing having a cavity for receiving a plug portion of a mating connector and an interface plate, the interface plate having a front face substantially flush with an outer surface of the device housing and an aperture aligned with the cavity, wherein the interface plate comprises an electrically conductive polymer and is electrically coupled to a ground;

wherein the aperture includes an inner surface and at least one interference feature protruding from the inner surface.

15. The method of claim 2 further comprising installing the electrical receptacle connector on a printed circuit board and forming an electrical connection between the interface plate and a ground on the printed circuit board.

16. The electronic device set forth in claim 14 wherein the at least one interference feature comprises a protuberance from the inner surface of the aperture.

17. The electronic device set forth in claim 14 wherein a plurality of electrical contacts are disposed within the cavity.

18. The electrical receptacle connector set forth in claim 8 wherein the aperture includes an inner surface and at least one interference feature protruding from the inner surface.

19. The electrical receptacle connector set forth in claim 18 wherein the at least one interference feature protrudes from the inner surface into the aperture.

* * * * *